United States Patent [19]

Bianchi

[11] Patent Number: 4,613,068

[45] Date of Patent: Sep. 23, 1986

[54] CARTRIDGE BELT

[76] Inventor: John E. Bianchi, 100 Calle Cortez, Temecula, Calif. 92390

[21] Appl. No.: 667,956

[22] Filed: Nov. 5, 1984

[51] Int. Cl.[4] ..... B65D 25/10

[52] U.S. Cl. ..... 224/242; 224/203; 224/224

[58] Field of Search ..... 224/203, 224, 231, 242, 224/246, 247, 248, 251, 918, 250, 239; 206/3

[56] References Cited

U.S. PATENT DOCUMENTS

| | | | |
|---|---|---|---|
| 243,363 | 6/1881 | Crouch | 224/224 |
| 1,016,231 | 1/1912 | Robie | 224/203 |
| 1,227,266 | 5/1917 | Himelspach | 224/239 X |
| 2,264,481 | 12/1941 | Peterson | 224/250 X |
| 2,692,599 | 10/1954 | Creelman | 224/248 X |
| 3,702,671 | 11/1972 | Cirillo | 224/243 |
| 3,819,095 | 6/1974 | Snyder | 224/248 |
| 4,413,762 | 11/1983 | Carini | 224/250 |

FOREIGN PATENT DOCUMENTS

| | | | |
|---|---|---|---|
| 1352252 | 1/1963 | France | 224/203 |

*Primary Examiner*—Stephen Marcus
*Assistant Examiner*—Robert Petrik
*Attorney, Agent, or Firm*—Wagner & Middlebrook

[57] ABSTRACT

An improved cartridge belt, the outer surface of which carries two superimposed cartridge loops with at least the inner loops elastic and stretched to lie flat against the belt when not in use. The outer cartridge loops may be elastic or inelastic but dimensioned to carry larger diameter cartridges. The top edges of the belt loops are aligned so that rim edge support for larger cartridges is provided at both the outer and inner sides of the belt loop.

6 Claims, 10 Drawing Figures

CARTRIDGE BELT

BACKGROUND OF THE INVENTION

Cartridge belts are probably as old as firearm cartridges themselves. When firearms progressed from ball, wadding, powder and powder horn to cartridges, undoubtedly the earliest hunters or riflemen secured loops to their belts to allow cartridges to be carried around their waist or over their shoulder as a bandolier. An example of an early, i.e. post Civil War, cartridge belt is illustrated on page 5 of *Blue Steel and Gunleather,* John E. Bianchi, copyright 1978, Beinfeld Publishing Co., North Hollywood, CA.

Typical of cartridge belts is a design in which a relatively wide belt, e.g. 2 to 3 inches and has a conventional sturdy buckle. Extending around approximately two thirds of the length is a continuous overlying leather strip, narrower in width than the belt and sewn to the belt by vertical stitch lines which form loops between each stitch line.

The belt is selected to match the girth of the wearer, subject to the normal adjustment possible with a buckle and a number of holes. The cartridge loops are designed to hold a particular caliber cartridge snugly with the rim of the casing resting on the top of the cartridge loop and the bullet extending through and sometimes below the loop. Frictional engagement between the casing side wall and the cartridge loop holds the cartridge in place. Finger pressure on the tip of the bullet is sufficient to force the cartridge upward and out of the cartridge loop and into the wearer's hand.

In certain cases, particularly where fabric belts have been used, the cartridge loop is made of elastic material so that the loops may accomodate more than one size cartridge. In no case, to my knowledge, has a cartridge belt been able to accommodiate the full range of cartridge sizes commonly used by shooters of handguns, namely .22 to .458 caliber cartridges.

BRIEF DESCRIPTION OF THE INVENTION

I recognized that little has been done throughout the years to increase the adaptability of cartridge belts with respect to the wearer or to the cartridges which he may desire to shoot. Recent advances in materials have made available fabric materials such as ballistic Nylon and hook and eye type fastener material which appeared to me to allow greater flexibility than heretofore possible in the design of both holster and cartridge belts.

I have accomplished the dual objectives of an improved adjustable belt and full cartridge adaptability, particularly in a fabric belt but also adaptable to leather belts as well. The cartridge belt has secured to its outer surface, a pair of superimposed cartridge loop strips. At least the inner of the strips is of elastic material but preferably the outer strip is elastic as well.

The inner strip is sewn or otherwise secured to the cartridge belt flat against the belt surface, or if formed into loops, of significantly smaller loop size than the outer loop. The outer loops are dimensioned to receive and hold the largest caliber cartridge desired to be carried. This may be as large as .458 magnum caliber particularly if the outer loop is of elastic material. Such outer loops are dimensioned to hold securely a cartridge as small as a .32 caliber with the minimum degree of stretch consistent with secure holding of the cartridge. The inner loops will securely hold cartridges as small as .22 short caliber.

In one embodiment, the outer and inner loops are both of elastic material with both loops normally stretched to lie flat against the outer surface of the belt. The inner loop material exhibits sufficient stretchability to receive smaller caliber cartridges and the outer loop material extendable to hold larger cartridges.

BRIEF DESCRIPTION OF THE DRAWING

This invention may be more clearly understood from the following detailed description and be reference to the drawing in which.

DETAILED DESCRIPTION OF THE INVENTION

Figure 1:
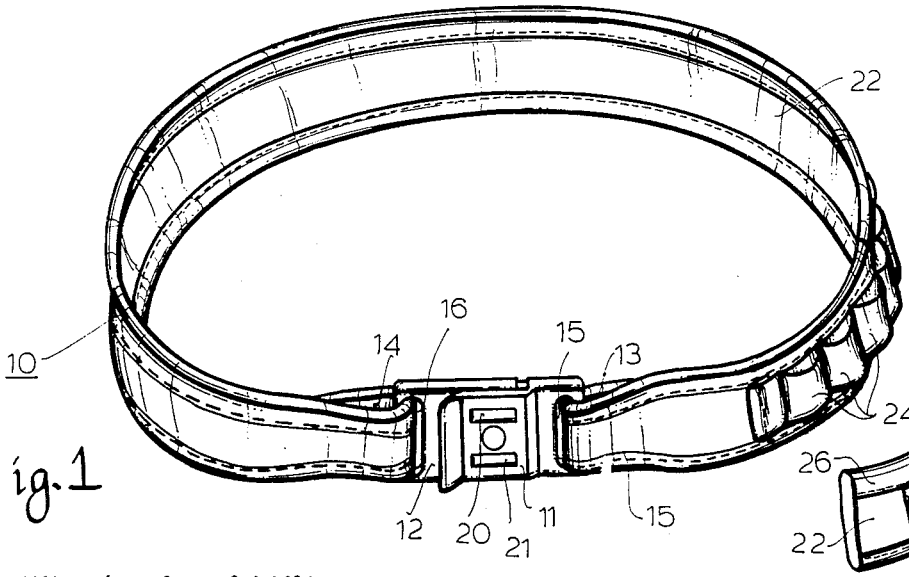
FIG. 1 is a perspective view of a cartridge belt of this invention.
Figure 3A:
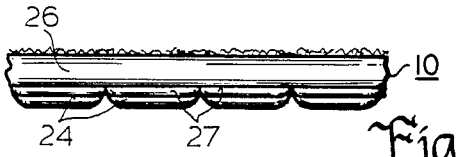
FIG. 3A is a fragmentary top plan view of the alternate embodiment of FIG. 1A.
Figure 3:
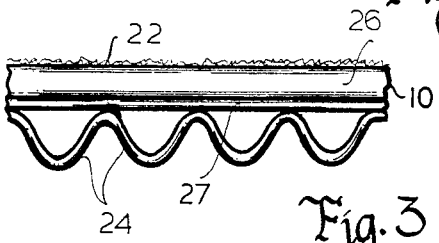
FIG. 3 is a fragmentary top plan view of the cartridge belt of FIG. 1 without any cartridges in place.
Figure 4:
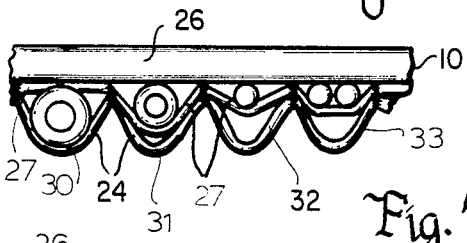
FIG. 4 is a view similar to FIG. 3 with a variety of sizes of cartridges being carried.
Figure 2:
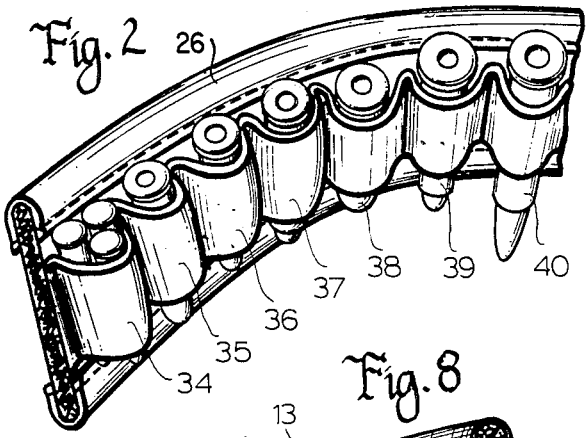
FIG. 2 is an enlarged fragmentary perspective view of a section of the belt of FIG. 1 showing a variety of ammunition sizes held in identical cartridge loops.

Now referring to FIG. 1 in conjunction with FIGS. 2–4, a cartridge belt 10 in accordance with this invention may be seen including a two part buckle 11 and 12. The ends 13 and 14 of the belt 10 are shown tapered to a narrower section to pass through respective slots 15 and 16 in the buckle parts 11 and 12. The buckles include catches 20 and 21 or other type of fastener to hold the two buckle parts 11 and 12 together when the belt 10 is worn.

Figure 8:
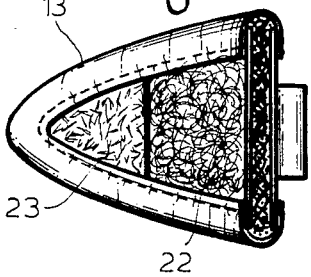
FIG. 8 is a fragmentary perspective view of on of the ends of the cartridge belt of this invention.
Figure 6:
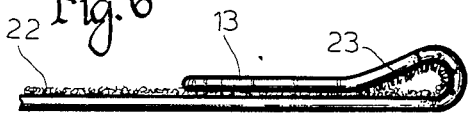
FIGS. 6 and 7 are fragmentary edge views of an end of the cartridge belt of this invention at different end length adjustments.
Figure 7:
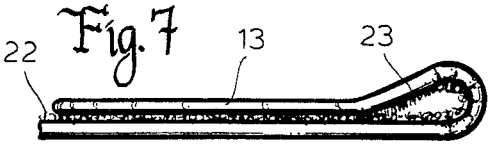

As shown in FIG. 1, the belt 10 is buckled and the buckle part 12 located on the belt end 14. The end 13 has passed through the slot 15 in buckle part 11 and is reversed to lie along the inner face 20 of the belt 10. The belt ends 13 and 14 each have a strip of one part of hook and eye or hook and pile fabric fastener material along the centerline of the ends, as seen in FIGS. 6–8. The hook and eye or hook and pile fabric is commonly referred to as "Velcro". Preferably the "hook" part 23 is sewn or secured to the end regions 13 and 14 of the belt 10, for approximately the six inches of its length. The mating "eye" or "pile" part 22 can extend for a similar distance inward beginning at the end of the "hook" part. A total of 12 inches of hook fastener fabric length allows a total of approximately 4 inches of adjustment in girth to the precise length which the wearer desires. The degree of adjustability is illustrated in FIGS. 6 and 7. In FIG. 6, the belt end 13 is adjusted to near maximum length while in FIG. 7 it is adjusted to approximately $2\frac{1}{2}$ inches shorter length. The pile fabric 22, preferably lines the entire intermediate length of belt 10 and acts as a soft resilient yet nonslip surface against the trousers of the wearer. This underlayer 22 provides an unforeseen advantage since it serves to hold the cartridge belt and its accompanying holster and handgun in precise position for the shooter.

The high degree of adjustability of the belt of this invention means that three belt sizes can provide the full range of 32 to 44 inch waist needs as compared to most belts which require as many as 6 sizes to cover that size range.

The waist adaptability advantage of this invention is described above. Of greater importance is the dual cartridge loop feature which allows virtually all sizes of handgun cartridges to be securely carried in any of the belt loops 24 of the belt 10. This is illustrated in FIGS. 2–4 in which the following cartridges are carried in successive identical cartridge loops:

| LOOP | CARTRIDGE |
|---|---|
| 30 | .32 caliber |
| 31 | .25 caliber |
| 32 | .22 short |
| 33 | .22 shorts (2) |
| 34 | .22 long rifles (3) |
| 35 | .25 caliber |
| 36 | .32 caliber |
| 37 | .38 caliber |
| 38 | .45 caliber |
| 39 | .357 magnum |
| 40 | .458 magnum |

Figure 5:
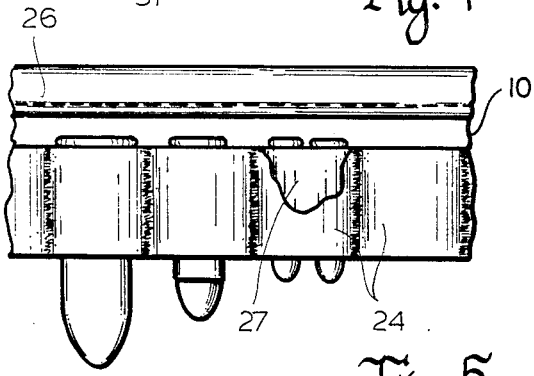
FIG. 5 is a fragmentary side elevational view of this invention, partly broken away to illustrate the superimposed double cartridge loops.

The feature which makes this adaptability possible is illustrated in FIGS. 3, 3A, 4 and 5, to which attention is now directed. The belt 10, when viewed from the top in FIG. 3, shows the inner pile 22 and edge seam material 26 on the inner and top faces, respectively. On the outer face (bottom in the drawing, FIG. 3), lying flat against the outer face of the belt 10 is the inner cartridge loop strip 27 of elastic material approximately $\frac{3}{4}$ inch (18.75 mm) in width and extending the full length of the cartridge loop strip 24. The inner elastic cartridge loop strip 27 normally lies flat against the outer face of the belt 10 as shown in FIG. 3. When larger caliber cartridges such as .32 caliber or larger are inserted in the larger loops 24, as shown in FIGS. 4 and 5, the inner loop strip 27 provides a resilient inner support for the cartridge, and its upper edge also serves to support the rim of the cartridge on the inner side, something which is missing from conventional cartridge belts. This is apparent in FIG. 4 in which loop 30 is shown with a .32 caliber cartridge in place supported by the outer strip 24 and the inner strip 27. A .25 caliber cartridge is held securely in loop 31 by the inner loop 24 within the outer loop 31. A single .22 caliber cartridge is carried securely in the inner loop of loop 32. In loop 33, a pair of rounds of .22 caliber rounds are easily held. The inner loops defined by strip 27 can each hold as few as one .22 round and as many as three, as illustrated in FIG. 2.

Figure 1A:
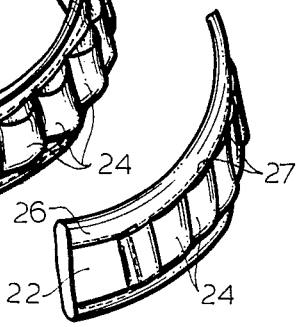
FIG. 1A is a fragmentary perspective view of an alternate embodiment of this invention.

I have also discovered that the outer loop 24 need not be expanded when not in use. This is illustrated in FIGS. 1A and 3A. The outer loop material 24 as well as the inner loop material 27 may be sewn slightly stretched or unstretched but not looped. That eliminates the loop appearance of the right of FIG. 1, more like the appearance of FIG. 1A. The difference is that the outer loops are now more closely confined against the belt for improved overall appearance. Also, the smaller cartridges which usually have smaller rims are held in place by the elasticity of both the outer and inner belt loops.

Although a shooter will normally only carry one size of ammunition at one time, he now can purchase one cartridge belt and be assured that it will fit him as snuggly as he desires despite changes in his waistline, and will carry virtually any size handgun ammunition.

With the cartridge belt of this invention, the shooter has a superior belt of greater adaptability than any previous belt and of reasonable or lower cost than heretofore.

The embodiment of this invention illustrated and described above is merely representative of the concept thereof and is not to be considered as limiting. The patent monopoly granted hereunder instead is gauged by the following claims including their equivalents.

What is claimed is:

1. An improved cartridge belt including a belt and a buckle, the improvement wherein said belt includes on its outer surface a plurality of cartridge loops;

said cartridge loops extending longitudinally along the belt outer surface;

said cartridge loops comprising a series of outer loops sized to accommodate larger caliber cartridges;

a second set of cartridge loops within said first series of cartridge loops;

said second set of cartridge loops being formed by elastic material normally lying flat against the surface of the belt but expandable outward by the insertion of a cartridge therein to hold smaller size cartridges.

2. The combination in accordance with claim 1 in which said first and second series of cartridge loops are secured to said belt by a common set of stitch lines extending through said first and second series of cartridge loops and into said belt.

3. A cartridge belt including a first set of cartridge loops formed from a continuous strip and secured to the belt body at a plurality of spaced points with a loop portion therebetween;

a second set of cartridge loops at least partially underlying said first set of cartridge loops;

said second set of cartridge loops being formed of elastic material and secured to the belt at a series of intermediate points generally corresponding to the points of securement of said first set of cartridge loops;

said second set of cartridge loops being expandable outward upon the insertion of a cartridge between the belt and respective second cartridge loop to receive and hold smaller caliber cartridges.

4. The combination in accordance with claim 3 wh said first set of cartridge loops is formed of elastic material whereby a larger size cartridge is secured between the first and second sets of elastic cartridge loops.

5. The combination in accordance with claim 3 wherein said first and second sets of cartridge loops have their upper edges at substantially the same level whereby a cartridge located within the outer loop has rim support at both the outer and inner sides thereof.

6. The combination in accordance with claim 3 wherein said first and second set of cartridge loops are elastic and when not in use, lie substantially flat against the belt and are expandable outward upon the insertion of a cartridge therein.

* * * * *